US008808150B2

(12) United States Patent
Choi

(10) Patent No.: US 8,808,150 B2
(45) Date of Patent: Aug. 19, 2014

(54) EXERCISE BICYCLE

(76) Inventor: Jang Won Choi, Gwangmyung-si (KR)

( * ) Notice: Subject to any disclaimer, the term of this patent is extended or adjusted under 35 U.S.C. 154(b) by 539 days.

(21) Appl. No.: 13/058,965

(22) PCT Filed: Jul. 22, 2009

(86) PCT No.: PCT/KR2009/004050

§ 371 (c)(1),
(2), (4) Date: Feb. 14, 2011

(87) PCT Pub. No.: WO2010/018936

PCT Pub. Date: Feb. 18, 2010

(65) Prior Publication Data

US 2011/0143887 A1 Jun. 16, 2011

(30) Foreign Application Priority Data

Aug. 12, 2008 (KR) ..... 10-2008-0079075

(51) Int. Cl.
*A63B 21/00* (2006.01)

(52) U.S. Cl.
USPC ..... 482/71; 482/72; 482/57; 482/63

(58) Field of Classification Search
USPC ..... 482/57, 64, 66, 51, 52, 62, 70
See application file for complete search history.

(56) References Cited

U.S. PATENT DOCUMENTS

| | | | | |
|---|---|---|---|---|
| 4,925,183 | A | 5/1990 | Kim | |
| 6,126,577 | A | 10/2000 | Chang | |
| 2007/0105694 | A1* | 5/2007 | Panatta | 482/57 |
| 2008/0020908 | A1 | 1/2008 | Ibarguren | |
| 2008/0119334 | A1* | 5/2008 | Peng | 482/64 |
| 2011/0152040 | A1* | 6/2011 | van der Meer | 482/57 |
| 2012/0088638 | A1* | 4/2012 | Lull | 482/57 |
| 2013/0157813 | A1* | 6/2013 | Irving et al. | 482/57 |

FOREIGN PATENT DOCUMENTS

KR 10-0751033 8/2007

OTHER PUBLICATIONS

International Search Report for PCT/KR2009/004050 mailed on Mar. 18, 2010.

* cited by examiner

*Primary Examiner* — Jerome W Donnelly
(74) *Attorney, Agent, or Firm* — Christopher Paul Mitchell

(57) ABSTRACT

An exercise bicycle wherein when rotating the wheels by rotating pedals, the user feels the bicycle moving forward and being tilted left and right as when riding a bicycle outdoors, and also feels as if the user is riding on a slope, a plain road, etc., thus preventing the user from feeling monotonous and tedious and allowing the user to feel as if the user is riding a bicycle outdoors, thereby increasing the amount of exercise.

11 Claims, 9 Drawing Sheets

EXERCISE BICYCLE

RELATED APPLICATIONS

This application is a 371 application of International Application No. PCT/KR2009/004050, filed Jul. 22, 2009, which in turn claims priority from Korean Patent Application No. 10-2008-0079075, filed Aug. 12, 2008, each of which is incorporated herein by reference in its entirety.

TECHNICAL FIELD

The present invention relates to an exercise bicycle, in more detail an exercise bicycle that allows a user to move the center and moves left and right as if the user rides on a bicycle outdoors and feels as if the user rides on a slope or a plain road etc. by rotating the pedals to rotate the wheels, thus preventing the user from feeling monotonous and tedious and allowing the user to feel as if the user rides on a bicycle outdoors, thereby increasing the amount of exercise.

BACKGROUND ART

In general, as modern people's interest in health recently increases, diet has been popular due to a worry about obesity and the body line. In particular, most people use exercise bicycles to train the lower body and increase flexibility with a small amount of exercise load for a short period of time in a small space.

That is, as shown in FIG. 1, an exercise bicycle 100 of the related art is exercise equipment that includes handlebars 102 connected to the upper portion of a support frame 101, a panel 103, a saddle 104, and a driving device 106 disposed between the handlebars 102 and the saddle 104 and coupled with pedals 105, in which the driving device 106 is operated by the pedals 105.

Therefore, as a user puts the feet on the pedals 105 and rotates the pedals 105 in the normal direction, on the saddle 104 of the exercise bicycle 100, the driving device 110 coupled with the pedals 105 rotates, thereby the lower body is trained, such that it can provide modern people who are lack of exercise with an exercise effect for a short period of time in a small exercise space.

The exercise bicycle 100 of the related art allows the user to drive only the pedals 105, on the saddle 104, such that the user may be bored or feel monotonous and may be sick of the exercise bicycle 100; therefore, it is difficult to expect increasing the exercise effect.

DISCLOSURE

Technical Problem

The present invention has been made in an effort to solve the problems and it is an object of the present invention to provide an exercise bicycle that allows a user to move the center and moves left and right as if the user rides on a bicycle outdoors and feels as if the user rides on a slope or a plain road etc. by rotating the pedals to rotate the wheels, thus preventing the user from feeling monotonous and tedious and allowing the user to feel as if the user rides on a bicycle outdoors, thereby increasing the amount of exercise.

Technical Solution

The present invention provides an exercise bicycle comprising: a bicycle member 100 including a saddle 110 where a user sits, handlebars 120 for changing directions, a front wheel 150 connected with the handlebars 120 through a frame, and pedals 140 that the user places the feet on; a torque increasing unit 200 increasing and changing torque generated by the pedals 140; a vertical power transmission unit 300 vertically transmitting the torque of the torque increasing unit 200; a horizontal power transmission unit 400 horizontally transmitting power from the vertical power transmission unit 300; a rear moving unit 500 disposed between the vertical power transmission unit 300 and the horizontal power transmission unit 400 and keeping the torque generated by the pedals 140 and the angle of the bicycle member 100 in the traveling direction; a front wheel driving unit 600 connected with the horizontal power transmission unit 400 to drive the front wheel; a traveling effect adjusting unit 700 implementing an effect as if traveling on a slope and a plain road by moving up/down the front wheel driving unit 600; a tension adjusting unit 900 adjusting the magnitude of torque transmitted when the front wheel driving unit 700 is pivoted and inclined by the operation of the front wheel driving unit 600; and a base 800 equipped with movable wheels 820 on the bottom of a plate 810 where the bicycle member 100 is placed, height adjusting members 830 at a predetermined distance, and a foot supports 840 allowing the user to ride on the bicycle member 100 and fixing frames 850 keeping other people away in exercising, on the sides.

Advantageous Effects

As described above, according to the present invention, it is possible to allow a user to move the center and moves left and right as if the user rides on a bicycle outdoors and feels as if the user rides on a slope or a plain road etc. by rotating the pedals to rotate the wheels, thus preventing the user from feeling monotonous and tedious and allowing the user to feel as if the user rides on a bicycle outdoors, thereby increasing the amount of exercise.

REFERENCE NUMERALS

| | |
|---|---|
| 100: Bicycle member | 110: Saddle |
| 120: Handlebars | 150: Front wheel |
| 200: Torque increasing unit | |
| 210, 250, 330, 340a, 340b, 410a, 410b: Rotary shaft | |
| 220: Front sprocket assembly | |
| 260, 310, 560, 640: Pulley | |
| 270: Rear sprocket assembly | |
| 290, 530, 610: Belt | 300: Vertical power transmission unit |
| 320a, 320b, 350a, 350b, 430a, 430b: Gear member | |
| 360: Connecting member | |
| 400: Horizontal power transmission unit | |
| 420a, 420b: Connecting joint | |
| 430: Spline shaft | 440: Rotary rod |
| 460: Driving pulley | 500: Rear moving unit |
| 510: Driving motor | 520: Driving pulley |
| 540: Guide bar | 570: Holder |
| 580: Housing | 550: Movable screw |
| 600: Front wheel driving unit | |
| 620: Conveyer belt | 630: Roller |
| 600: Housing | |
| 700: Traveling effect adjusting unit | |
| 710: Driving motor | |
| 720: Worm gear | 730: Worm wheel |
| 740: Rotary rod | 750: Operation member |
| 760: Driving pulley | 780: Driven pulley |
| 800: Base | 810: Plate |
| 820: Movable wheel | 830: Height adjusting member |
| 840: Foot support | 850: Fixing frame |
| 900: Tension adjusting unit | |
| 910: Flywheel | 920: Brake panel |
| 930: Magnet | 940: Cable |

BEST MODE

Hereinafter, preferred embodiments of the present invention are described in detail with reference to the accompanying drawings.

Figure 1:
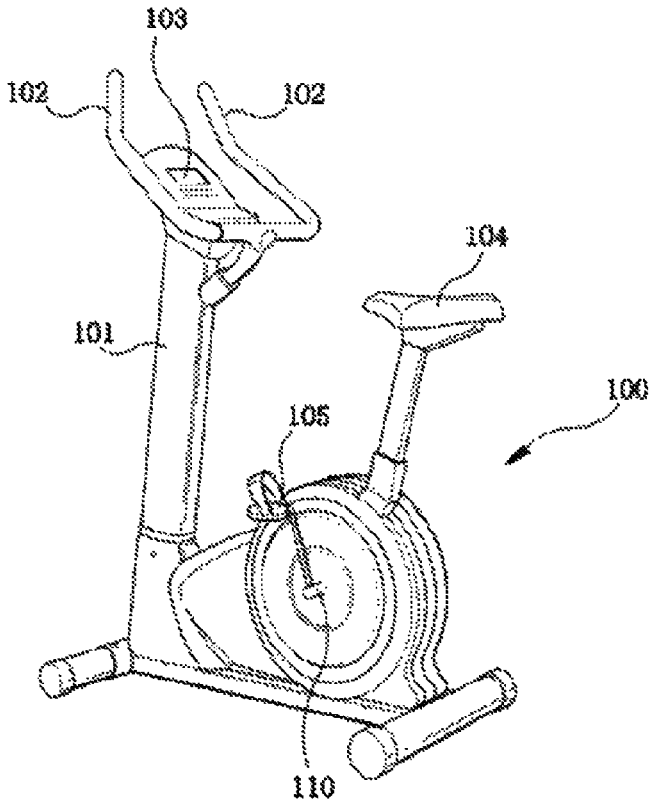
FIG. 1 is a perspective view showing an exercise bicycle according to the related art.
Figure 2:
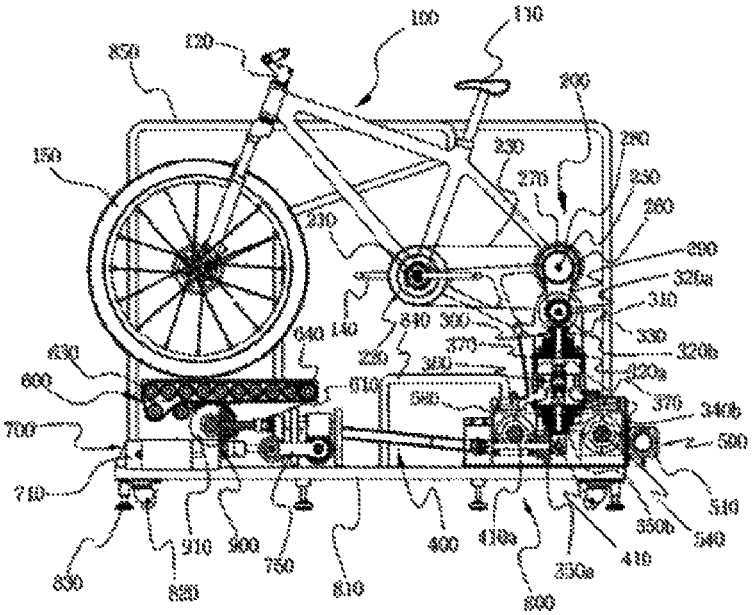
FIG. 2 is a front cross-sectional view showing the structure of an exercise bicycle according to the present invention.
Figure 3:
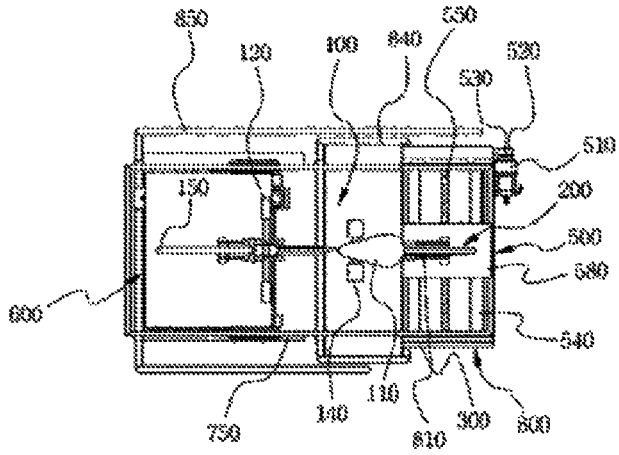
FIG. 3 is a side view showing the structure of the exercise bicycle according to the present invention.
Figure 4:
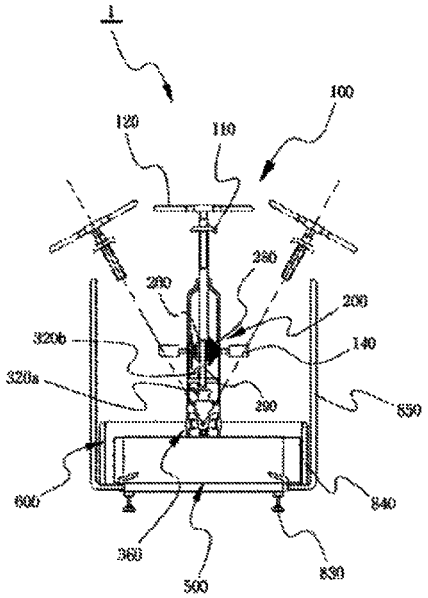
FIG. 4 is a plan view showing the structure of the exercise bicycle according to the present invention.

FIGS. 2 to 4 are a front cross-sectional view, a side view, and a plan view showing the structure of an exercise bicycle according to the present invention. Referring to the figures, an exercise bicycle of the present invention includes: a bicycle member having a saddle 110 where a user sits and pedals 140 that the user places the feet on; a torque increasing unit 200 that increases and changes torque generated by the pedals 140; a vertical power transmission unit 300 that vertically transmits the torque from the torque increasing unit 200; a horizontal power transmission unit 400 that horizontally transmits power from the vertical power transmission unit 300; a rear moving unit 500 that is disposed between the vertical power transmission unit 300 and the horizontal power transmission unit 400 and makes the torque generated from the pedals 140 and the angle of the bicycle member 100 parallel in the traveling direction; a front wheel driving unit 600 that connected with the horizontal power transmission unit 400 to drive the front wheel; a traveling-effect adjusting unit 700 that implements an effect as if traveling on a slope and a plain road by moving up/down the front wheel driving unit 600; and a tension adjusting unit 900 and a base 800 which adjust the magnitude of torque that is transmitted when the front wheel driving unit 700 is high-rotated and makes an inclination by the operation of the front wheel driving unit 600.

The bicycle member 100 includes the saddle 110 where the user sits, the handlebars 120 for changing direction, a front wheel 150 connected with the handlebars 120 through a frame, the pedals 140 that the user places the feet on, and a brake that stops the front wheel 150 or the torque increasing unit 200.

Figure 5:
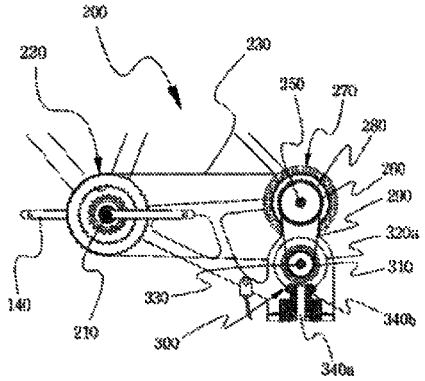
FIG. 5 is a front view showing the structure of a torque increasing unit that is a main part of the present invention.

The torque increasing unit 200 that increases and changes the torque generated by the pedals 140, as shown in FIG. 5, includes a front sprocket assembly 220 composed of a multi-stage sprocket is fitted on a rotary shaft 210 that is rotated by the pedals 140 and a rear sprocket assembly 270 in which a multi-stage sprocket is rotatably disposed by a chain 230 at a predetermined distance behind the rear sprocket assembly and a pulley 260 is integrally formed with the rotary shaft 250.

Figure 6:
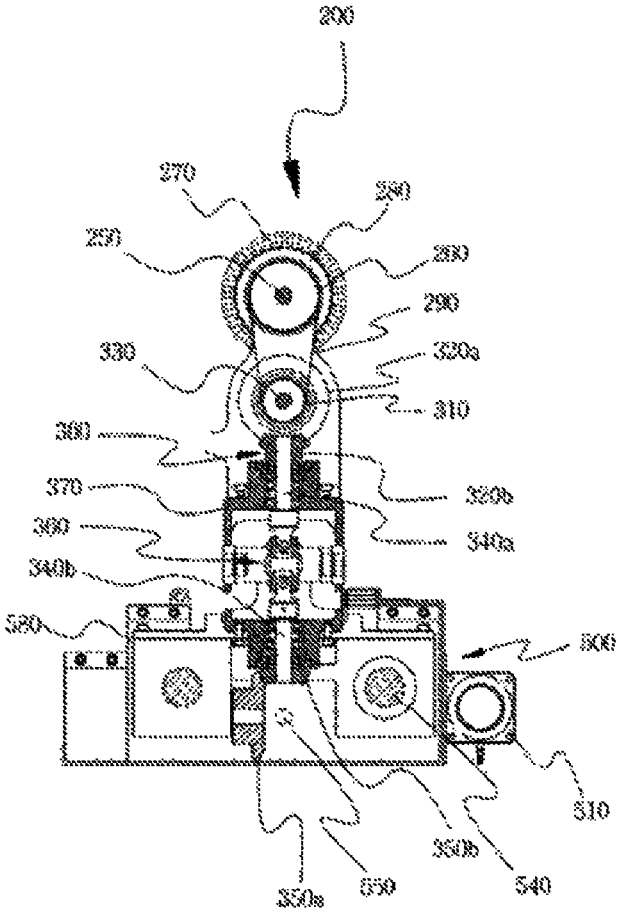
FIG. 6 is a front cross-sectional view showing the structure of a vertical power transmission unit that is a main part of the present invention.
Figure 7:
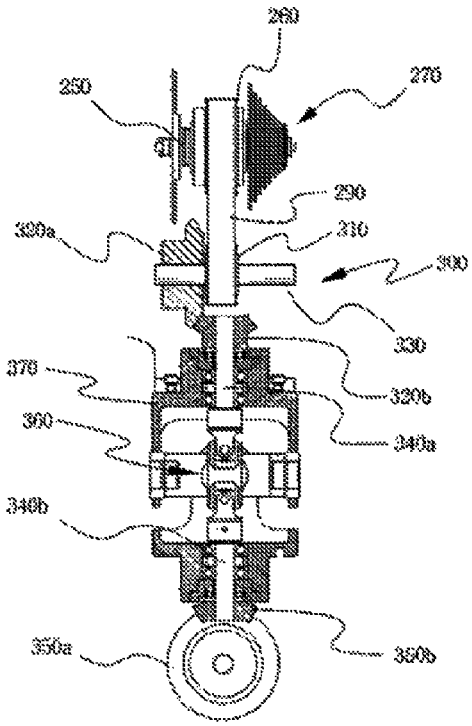
FIG. 7 is side cross-sectional view showing the structure of a vertical power transmission unit that is a main part of the present invention.

In the vertical power transmission unit 300 that vertically transmits torque from the torque increasing unit 200, as shown in FIGS. 6 and 7, a pulley 310 and gear members 320*a* and 320*b* which are connected with the rear sprocket assembly 270 by a belt 290 is fitted on a shaft, a rotary shaft 340*a* is fitted in the gear member 320*b*, gear members 350*a* and 350*b* are fitted on a shaft, opposite to the gear members 320*a* and 320*b*, a shaft 340*b* is fitted in the gear member 350*b*, the rotary shafts 340*a* and 340*b* are connected by a connecting member 360, and the connecting member 360 is disposed in a casing 370 that keeps the gap between the gear member 320*b* and the gear member 350*b*.

Figure 8:
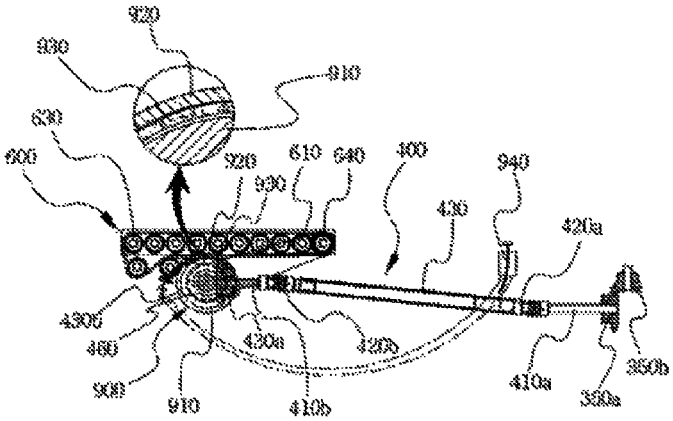
FIG. 8 is a front cross-sectional view showing the structure of a horizontal power transmission unit and a front wheel driving unit that are main parts of the present invention.

In the horizontal power transmission unit 400 that horizontally transmits torque from the vertical power transmission unit 300, as shown in FIG. 8, a rotary shaft 410*b* opposite to the rotary shaft 410*a* fitted in the gear member 350*a* of the vertical power transmission unit 300, connecting joints 420*a* and 420*b* are fitted on the ends of the rotary shafts 410*a* and 410*b*, a spline shaft 430 is connected between the connecting joints 420*a* and 420*b*, a gear member 430*a* is fitted on the rotary shaft 410*b*, a gear member 430*b* is fitted on a rotary rod 440 to be engaged with the gear member 430*a*, and a driving pulley 460 is fitted on the rotary rod 440.

Figure 12:
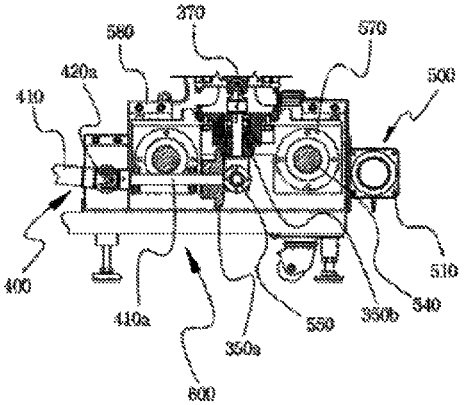
FIG. 12 is a front cross-sectional view showing the structure of a rear moving unit that is a main part of the present invention.
Figure 13:
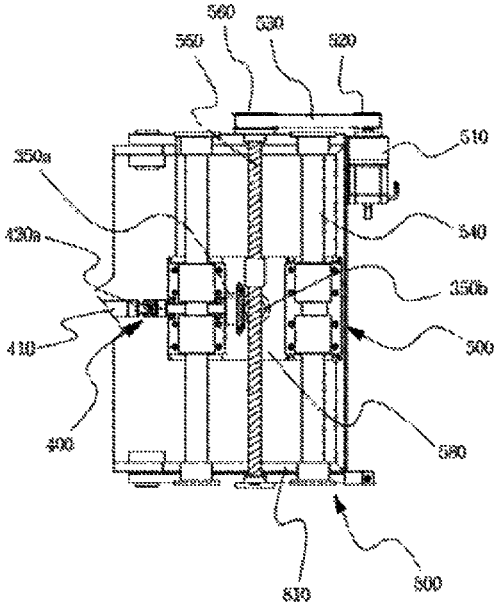
FIG. 13 is a plan view showing the structure of the main part of the present invention.
Figure 14:
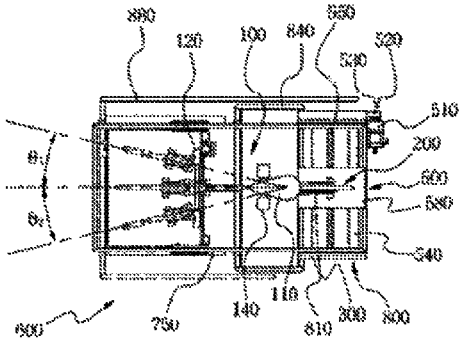
FIG. 14 is a plan view showing when the front wheel is steered.

In the rear moving unit 500 disposed between the vertical power transmission unit 300 and the horizontal power transmission unit 400 to change the direction of power, as shown in FIGS. 12 and 13, holders 570 moving along guide bars 540 disposed at a predetermined distance in parallel with each other are fixed to a housing 580.

A movable screw 550 equipped with a pulley 560 at one end is disposed in parallel between the guide bars 540 at both ends and the pulley 560 has a structure in which a driving motor 510 having driving pulleys 520 connected by a belt 530.

In the front wheel driving unit 600 that is connected with the horizontal power transmission unit 400 to drive the front wheel, a conveyer belt 620 is disposed on rollers 630 disposed at a predetermined distance and a pulley 640 connected with the driving pulley 460 by a belt 610 is coupled to the roller 630 at the end by a shaft and disposed in a housing 660 rotatably disposed.

In the traveling effect adjusting unit 700 that implements an effect as if traveling a slope and a plain road by moving up/down the front wheel driving unit 600, a driven pulley 780 that is connected to the driving pulley 760, which is connected with the rotary shaft of the driving motor 710 to be rotated, by a belt 770 to be driven.

Figure 16:
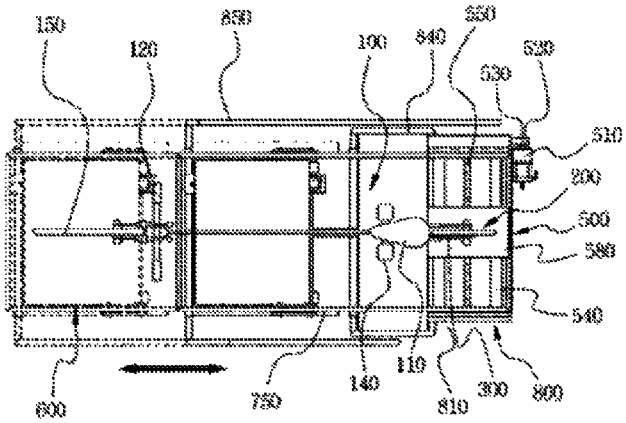
FIG. 16 is a plan view showing another embodiment of the present invention.

As shown in FIG. 16, the front wheel driving unit 600 can move forward/backward. This is for easily replacing the bicycle member 100, depending on the body conditions of users.

A rotary rod 740 that rotatably supports a worm wheel 730 engaged with a worm gear 720 is fitted in a worm gear 720 connected to a rotary shaft of the driven pulley 780 and an operation member 750 has one end fixed to the rotary rod 740 and the other end connected to the housing 660.

The tension adjusting unit 900 includes a brake panel 920 that is disposed at a predetermined distance from a flywheel 910 fitted on a shaft and rotatably mounted on the housing 660 by a hinge. Meanwhile, a plurality of magnets 930 is fixed to the brake panel 920 and one end of a cable 940 is connected to the brake panel 920 and the other end is fixed to the housing 660.

Meanwhile, in the base 800, movable wheels 820 are attached to the bottom of a plate 810 where the bicycle member 100 is disposed, height adjusting members 830 are attached at a predetermined distance, and foot supports 840 allowing a user to ride on the bicycle member 100 and fixing frames 850 that keeps other people away in exercising are formed on the sides.

The present invention having the structure described above has the following effects. It is possible to move the plate 810 at a position at least higher than the entire height of the movable wheels 820 from the ground by using the height adjusting members 830 under the plate 810 where the bicycle member 100 is disposed.

The reason is because the bicycle is shaken by the movable wheels 820, when the height is small, and the height of the plate 810 is adjusted lower by the height adjusting members 830 only when the entire exercise bicycle 1 of the present invention.

Meanwhile, the bicycle member 100 is inclined toward the fixing frames 850 at both sides before being used, as shown in FIG. 3, in which as the user stands up the bicycle member 100 and supplies power, using a switch in a control box (not shown), the driving motor 510 operates, the driving pulley 520 fitted on the rotary shaft rotates, the pulley 560 connected by the belt 530 correspondingly operates and rotates the movable screw 550, such that the rear moving unit 500 moves to the center of the housing 580 along the guide bars 540 disposed in parallel at a predetermined distance.

Therefore, the rear moving unit 500 is positioned at the center of the movable screw 550 and the guide bar 540 when power is supplied in the initial use, regardless of the previously used position.

As the user sits on the saddle 110 of the bicycle member 100, using the foot supports 840 and presses down the pedals 140 with feet, holding the handlebars 120, the torque increasing unit 200 is operated by the rotary shaft 210 where the pedals 140 are fitted.

The user should presses the pedals 140 as if riding a bicycle outdoors to keep the balance because the bicycle falls down when not pressing down the pedal 140 of the bicycle member 100 with feet, the fixing frames 850 prevents other people from hitting the user in exercising by keeping the people away or may be used for keep the balance when the user takes a break for a moment on the saddle.

According to the rotation of the torque increasing unit 200, as shown in FIG. 5, as the rear sprocket assembly 220 including the multi-state sprocket fitted on the rotary shaft 210 that is rotated by the pedals 140 rotates, the rear sprocket assembly 270 at a predetermined distance behind the front sprocket assembly is correspondingly rotated, because it is connected by the chain 230.

The connection between the rear sprocket assembly 220 and the rear sprocket assembly 270 by the chain 230 makes is possible to freely adjust the speed of the bicycle by using a specific adjusting unit on the handlebars, as in a common method of driving a bicycle. Meanwhile, the pulley 260 is integrally formed with the rotary shaft 250 where the rear sprocket assembly 270 is fitted, such that the pulley 260 is correspondingly rotated.

As the pulley 260 rotates with the rear sprocket member 270, the pulley 310 connected by the belt 290 rotates, such that the torque from the pedals 140 pressed down by the user's feet is vertically transmitted by the vertical power transmission unit 300.

According to the operation of the vertical power transmission unit 300, as shown in FIGS. 6 and 7, as the pulley 310 connected by the belt 290 rotates, the rotary shaft 330 rotates and the gear member 320*a* fixed on the rotary shaft 330 rotates, such that the gear member 320*b* engaged with the gear member 320*a* is rotated by the rotation of the gear member 320*a*.

Meanwhile, as the gear member 320*b* rotates, the rotary shaft 340*a* rotatably fixed in the gear member 320*b* to support the gear member 320*b* rotates. In this operation, the gear members 350*a* and 350*b* opposite to the gear members 320*a* and 320*b* correspondingly rotate.

Since the rotary shaft 340*b* rotatably supporting the gear member 350*b* and the rotary shaft 340*a* rotatably fitted in the gear member 320*b* are connected by the connecting member 360, power (torque) by the rotation of the gear members 350*a* and 350*b* can be transmitted can be vertically transmitted and the gap between the gear member 320*b* and the gear member 350*b* is kept by the casing 370.

Meanwhile, the power (torque) vertically transmitted is horizontally transmitted forward where the front wheel is disposed. According to the operation of the horizontal power transmission unit 400, as shown in FIG. 8, as the rotary shaft 410*a* fitted in the gear member 350*a* of the vertical power transmission unit 300 rotates, the connecting joint 420*a* at the end of the rotary shaft 410*a* rotates, such that the opposite rotary shaft 410*b* and the connecting joints 420*a* and 420*b* at the ends of the rotary shaft 410*b* rotate.

In this operation, since the spline shaft 430 that changes the axial length and transmits power by easily moving toward the shaft is disposed between the connecting joints 420*a* and 420*b*, power can be horizontally transmitted. Further, since the gear member 430*a* is fitted on the rotary shaft 410*b* and the gear member 430*b* is engaged with the gear member 430*a* and fitted on the rotary rod 440, such that as the rotary rod 440 rotates, the driving pulley 460 rotates.

The power transmitted forward where the front wheel 150 is disposed rotates the pulley 640 connected with the driving pulley 460 by the belt 610, such that the conveyer belt 620 supported by the rollers 630 disposed at a predetermined distance rotates. As the conveyer belt 620 rotates, the front wheel 150 rotates, such that the user feels as if riding the bicycle on the ground and prevents malfunction due to foreign substances flowing in the housing 660.

Figure 9:
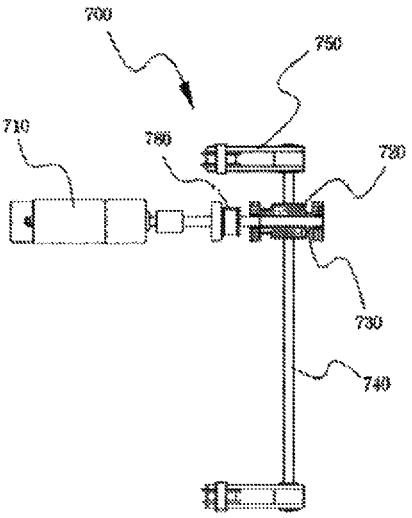
FIG. 9 is a front cross-sectional view showing the structure of a traveling-effect adjusting unit that is a main part of the present invention.
Figure 10:
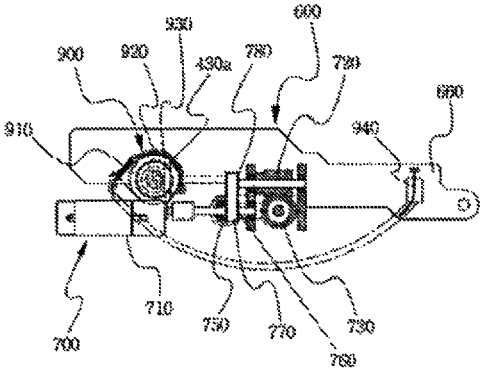
FIG. 10 is a plan cross-sectional view showing the structure of a traveling-effect adjusting unit that is a main part of the present invention.
Figure 11:
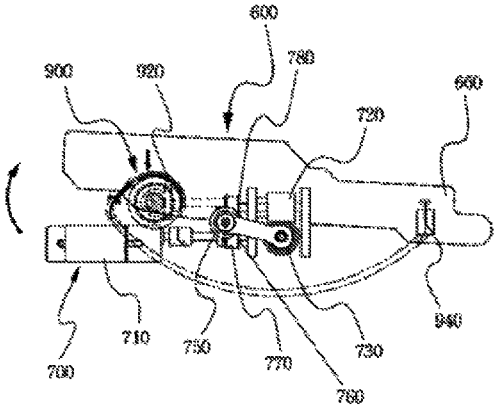
FIG. 11 is a front cross-sectional view showing the operation of the traveling-effect adjusting unit that is a main part of the present invention.

The traveling method using the exercise 1 of the present invention described above is a plain road traveling and a slop traveling and the operation described above is to achieve an effect as if traveling on a plain road, and in the slope traveling method, as shown in FIGS. 9, 10, and 11, the conditions for traveling on a slope is adjusted by operating the traveling effect adjusting unit 700.

The plain road traveling adjustment of the traveling effect adjusting unit 700 implies when the front wheel driving unit 600 is kept horizontal by the switch in the control box (not shown), and in the slope traveling adjustment, the driving motor 710 is operated and the driving pulley 760 connected to the rotary shaft of the driving motor 710 is driven.

The driving pulley 760 is connected with the driving pulley 780 by the belt 770 to be driven, and as the worm gear 720 connected to the rotary shaft of the driven pulley 780 and the worm wheel 730 engaged with the worm gear 720 rotate, the rotary shaft 740 rotatably supporting the worm wheel 730 rotates.

Therefore, as the rotary rod 740 rotates, the operation member 750 having one end fixed to the rotary rod 740 and the other end connected to the housing 660 rotates and lifts up the front portion of the hinged housing 660, such that the housing 660 is inclined and the front wheel is lifted up, and accordingly, the user of the exercise cycle of the present invention can exercise with a feeling like traveling on a slope.

When the bicycle travels on a slop, as described above, more force is required to press down the pedals 140, which is because the gravity acts, such that the torque is influenced to achieve a feeling as if the exercise bicycle of the present invention travels on a slope outdoors and a feeling like traveling on a slope is achieved.

As the front wheel driving unit 600 is inclined by the traveling effect adjusting unit 700, as shown in FIG. 11, the torque generated by the pedals is influenced by the tension adjusting unit 900, such that it is possible to achieve an effect of increasing the amount of exercise.

According to the operation of the tension adjusting unit 900, as shown in FIGS. 8 to 11, as the housing 660 pivots to incline the front wheel driving unit 600, the cable 940 is tightened and pulls the brake panel 920, such that brake panel 920 pivots to the flywheel 910.

As the brake panel 920 moves close to the flywheel 910, the torque of the flywheel 910 is reduced by the magnetic force of the magnets 930 fixed to the brake panel 920 and the rotational resistance increases, such that more force is required to press down the pedals 140, thereby achieving an effect of increasing the amount of exercise.

Meanwhile, in order to implement the plain road traveling after the slope traveling, the operation member 750 is returned to the initial position by reversing the driving motor 710 such that the housing 660 returns to the initial state, such that it is possible to achieve a feeling like the plain road traveling.

In this process, according to the operation of the tension adjusting unit 900, the cable 940 that has been tightened by the rotation of the housing 660 is loosened to the initial position by a return spring, such that the brake panel 920 pivots away from the flywheel 910 while the force pulling the brake panel 920 is removed, and the flywheel 910 also provides an effect of increasing the torque.

As the brake panel 920 moves away from the flywheel 910, the resistance that influences the torque of the flywheel 910 due to the magnetic force of the magnets 930 fixed to the brake panel 920 is reduced, such that it is possible to easily press down the pedals 140 without a large force.

Further, according to a method of changing the direction of the exercise bicycle of the present invention, it is possible to move in desired direction by turning the handlebars to the right side and the left side For example, when the handlebars are turned to the right side, the front wheel is turned to the right and the bicycle makes an angle θ1 to the right side, whereas when the handlebars are turned to the left, the front wheel is turned to the left and the bicycle makes an angle of θ2, in which the angles of the front wheel 150 is sensed and transmitted to the control box (not shown), such that a detection signal is generated and the rear moving unit 500 is moved in response to the detection signal.

Figure 15:
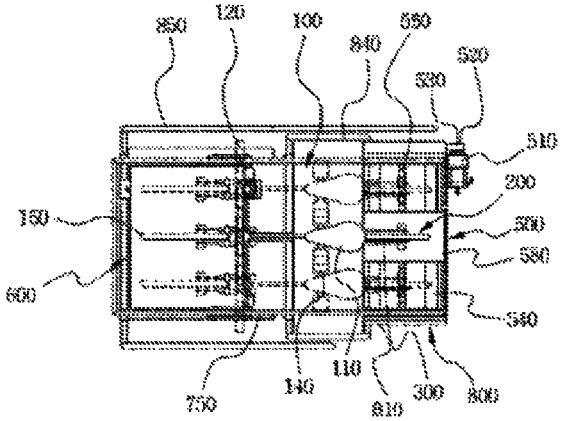
FIG. 15 is a plan view showing when the rear wheel is moved by steering the front wheel.

According to the operation of the rear moving unit 500, as shown in FIG. 15, as the driving motor 510 rotates, the driving pulley 520 fitted on the rotary shaft rotates and the pulley 560 connected with the driving pulley 520 by the belt 530 correspondingly rotates. As the pulley 560 rotates, the movable screw 550 rotates, such that housing 580 moves in the rotational direction of the rotary shaft along the guide bars 540 disposed at a predetermined distance in parallel.

The invention claimed is:

1. An exercise bicycle comprising:

a bicycle member 100 including a saddle 110 where a user sits, handlebars 120 for changing directions, a front wheel 150 connected with the handlebars 120 through a frame, and pedals 140 that the user places the feet on;

a torque increasing unit 200 increasing and changing torque generated by the pedals 140;

a vertical power transmission unit 300 vertically transmitting the torque of the torque increasing unit 200;

a horizontal power transmission unit 400 horizontally transmitting power from the vertical power transmission unit 300;

a rear moving unit 500 disposed between the vertical power transmission unit 300 and the horizontal power transmission unit 400 and keeping the torque generated by the pedals 140 and the angle of the bicycle member 100 in the traveling direction;

a front wheel driving unit 600 connected with the horizontal power transmission unit 400 to drive the front wheel;

a traveling effect adjusting unit 700 implementing an effect as if traveling on a slope and a plain road by moving up/down the front wheel driving unit 600;

a tension adjusting unit 900 adjusting the magnitude of torque transmitted when the front wheel driving unit 700 is pivoted and inclined by the operation of the front wheel driving unit 600; and a base 800 equipped with movable wheels 820 on the bottom of a plate 810 where the bicycle member 100 is placed, height adjusting members 830 at a predetermined distance, and a foot supports 840 allowing the user to ride on the bicycle member 100 and fixing frames 850 keeping other people away in exercising, on the sides.

2. The exercise bicycle according to claim 1, wherein the torque increasing unit 200 includes:

a front sprocket assembly 220 having a multi-stage sprocket on a rotary shaft 210 rotated by the pedals 140;

a rear sprocket assembly 270 having a multi-stage sprocket fitted on a rotary shaft 250 and a pulley 260 integrally formed at a side, at a predetermined distance behind the front sprocket assembly 220;

a chain 230 connecting the front sprocket assembly 220 with the rear sprocket assembly 270; and a belt 290 disposed on the pulley 260.

3. The exercise bicycle according to claim 1, wherein the vertical power transmission unit 300 includes:

a pulley 310 connected with the rear sprocket assembly 270 by a belt 290;

a gear member 320*a* fitted on a rotary shaft 330 together with the pulley 310;

a gear member 320*b* fitted on a rotary shaft 340*a* to be engaged with the gear member 320*a;* gear members 350*a* and 350*b* opposite to the gear members 320*a* and 320*b;* a connecting member 360 fitted on a rotary shaft 340*b* fitted in the gear member 350*b* and connecting the rotary shafts 340*a* and 340*b*; and a casing accommodating the connecting member 360 and keep the gap between the gear member 320*b* and the gear member 350*b*.

4. The exercise bicycle according to claim 1, wherein the horizontal power transmission unit 400 includes:

a rotary shaft 410*a* fitted in the gear member 350*a* of the vertical power transmission unit 300;

a rotary shaft 410*b* opposite to the rotary shaft 410*a;* connecting joints 420*a* and 420*b* connected to the ends of the rotary shafts 410*a* and 410*b;* a spline shaft 430 between the connecting joints 420*a* and 420*b;* a gear member 430*a* fitted on the rotary shaft 410*b* and a gear member 430*b* engaged with the gear member 430*a;* a rotary rod 440 fitted in the gear member 430 to rotate with the gear member 430; and a driving pulley 460 fitted on the rotary rod 440.

5. The exercise bicycle according to claim 1, wherein the rear moving unit 500 includes:

guide bars 540 disposed at a predetermined distance in parallel;

holders 570 moving along the guide bars 540;

a housing 580 fixing the holder 570;

a movable screw 550 disposed in parallel between the guide bars 540 at both ends and having the pulley 560 at one end;

and a driving motor 510 having a rotary shaft where a driving pulley 520 connected with the pulley 560 by a belt 530 is fitted.

6. The exercise bicycle according to claim 1, wherein the front wheel driving unit 600 includes:

rollers 630 disposed at a predetermined distance;

a conveyer belt 620 supporting the rollers 630 and rotating;

a pulley 640 fitted in the rollers 630; and a housing 660 where a pulley 640 connected with the driving pulley 460 by a belt 610 is rotatably disposed.

7. The exercise bicycle according to claim 1, wherein the traveling effect adjusting unit 700 includes:

a driving motor 710;

a driving pulley 760 connected with a rotary shaft of the driving motor 710 to rotate;

a driven pulley 780 connected with the driving pulley 760 by a belt 770 to be driven;

a worm gear 720 connected to a rotary shaft of the driven pulley 780;

a worm wheel 730 engaged with the worm gear 720;

a rotary rod 740 rotatably supporting the worm wheel 730; and an operation member 750 having one end fixed to the rotary rod 740 and the other end connected to the housing 660.

8. The exercise bicycle according to claim 6, wherein the housing 660 pivots at a predetermined angle.

9. The exercise bicycle according to claim 1, wherein the rear moving unit 500 moves in the direction of the front wheel that has been turned.

10. The exercise bicycle according to claim 1, wherein the tension adjusting unit 900 includes:

a flywheel 910 fitted on the rotary shaft;

a brake panel 920 rotatably disposed in the housing;

a plurality of magnets 930 fixed to the brake panel; and a cable 940 having one end fixed to the brake panel 920 and the other end fixed to the housing 660.

11. The exercise bicycle according to claim 1, wherein the pedals 140 are pressed down to keep the balance such that the bicycle member 100 does not fall down.

* * * * *